US006669028B2

(12) United States Patent
Aikawa

(10) Patent No.: US 6,669,028 B2
(45) Date of Patent: Dec. 30, 2003

(54) CYLINDRICAL SCREEN

(75) Inventor: Yoshihiko Aikawa, Shizuoka (JP)

(73) Assignee: Aikawa Iron Works Co., Ltd., Shizuoka (JP)

( * ) Notice: Subject to any disclaimer, the term of this patent is extended or adjusted under 35 U.S.C. 154(b) by 76 days.

(21) Appl. No.: 09/947,609

(22) Filed: Sep. 7, 2001

(65) Prior Publication Data

US 2003/0006173 A1 Jan. 9, 2003

(30) Foreign Application Priority Data

Jul. 5, 2001 (JP) ..... 2001-204268

(51) Int. Cl.[7] ..... B07B 1/18
(52) U.S. Cl. ..... 209/411; 209/406; 209/409
(58) Field of Search ..... 209/406, 409, 209/410, 411, 397, 399; 210/402, 404, 498, 499; 26/896.6, 896.62

(56) References Cited

U.S. PATENT DOCUMENTS 211,694 A * 1/1879 Bowman ..... 209/298
399,779 A * 3/1889 Rattan ..... 209/411
942,626 A * 12/1909 Dunham et al. ..... 171/129
1,631,517 A * 6/1927 Christel ..... 209/289
2,454,134 A * 11/1948 Burleson ..... 210/404
4,986,900 A * 1/1991 Mason ..... 209/397
5,647,128 A * 7/1997 Aikawa ..... 29/896.62
5,791,495 A * 8/1998 Gero et al. ..... 209/395
6,051,103 A * 4/2000 Aikawa ..... 162/55
6,491,168 B1 * 12/2002 Lutz et al. ..... 210/402

* cited by examiner

*Primary Examiner*—Donald P. Walsh
*Assistant Examiner*—Joseph C Rodriguez
(74) *Attorney, Agent, or Firm*—Kanesaka & Takeuchi

(57) ABSTRACT

In a cylindrical screen, a screen body has a height greater than its diameter, and is formed of a plurality of portions spaced apart from each other in a direction of the height. Each portion has slits laterally and vertically spaced apart from each other. At least one annular member is situated between two of the plurality of the portions of the screen body to be located radially inside an outer surface of the screen. The annular member has an annular concave formed in a middle thereof extending toward an inner side of the screen from the outer surface of the screen, and a width extending in the direction of the height. The width is greater than a distance of the slits vertically spaced apart from each other. Accordingly, a mat formed on the screen can be easily peeled off.

6 Claims, 8 Drawing Sheets

CYLINDRICAL SCREEN

BACKGROUND OF THE INVENTION AND RELATED ART STATEMENT

The present invention relates to a cylindrical screen, and particularly, it relates to a cylindrical screen in which a mat formed on a surface of the screen is liable to be peeled off.

There is a screen apparatus in which round holes or slits are formed on an outer peripheral surface of a cylindrical screen and a stirring member (agitator) is provided outside the cylindrical screen, to thereby remove foreign substances from a papermaking material.

However, in the aforementioned screen apparatus, although a screen cleaning operation is made by the agitator, fibers are accumulated on the surface of the screen to form a mat on the entire surface of the screen, and the mat is difficult to be peeled off, resulting in deteriorating a performance of the screen.

An object of the invention is to provide a cylindrical screen which solves the aforementioned problem.

Further objects and advantages of the invention will be apparent from the following description of the invention.

SUMMARY OF THE INVENTION

To achieve the aforementioned object, the present invention provides a cylindrical screen, which comprises a cylindrical shape having a height larger than a diameter; a plurality of screen bars disposed in parallel to each other and spaced away with intervals therebetween; a plurality of slits in longitudinal shapes respectively formed between two of the screen bars adjacent to each other; a ring for stopping the screen bars; and a member having a width larger than a thickness of the ring and disposed in a direction transversely crossing a longitudinal direction of the screen bars, in which the member divides the slits in the longitudinal shapes in a middle thereof.

Also, the present invention provides a cylindrical screen, which comprises a cylindrical shape having a height larger than a diameter; a screen plate having an outer peripheral surface; and a plurality of slits formed on the outer peripheral surface of the screen plate. In the cylindrical screen, the plurality of slits is disposed with small intervals therebetween in a vertical direction, and provided with a large interval larger than the small interval in a middle portion of the cylindrical screen.

Further, the present invention provides a cylindrical screen, which comprises a cylindrical shape having a height larger than a diameter; a screen plate having an outer peripheral surface; and a plurality of round holes formed on the outer peripheral surface of the screen plate. In the cylindrical screen, the plurality of round holes is disposed with small intervals therebetween in a vertical direction, and provided with a large interval larger than the small interval in a middle portion of the cylindrical screen.

DETAILED DESCRIPTION OF THE PREFERRED EMBODIMENT

A cylindrical screen according to an embodiment of the invention will be explained with reference to the attached drawings.

Figure 1:
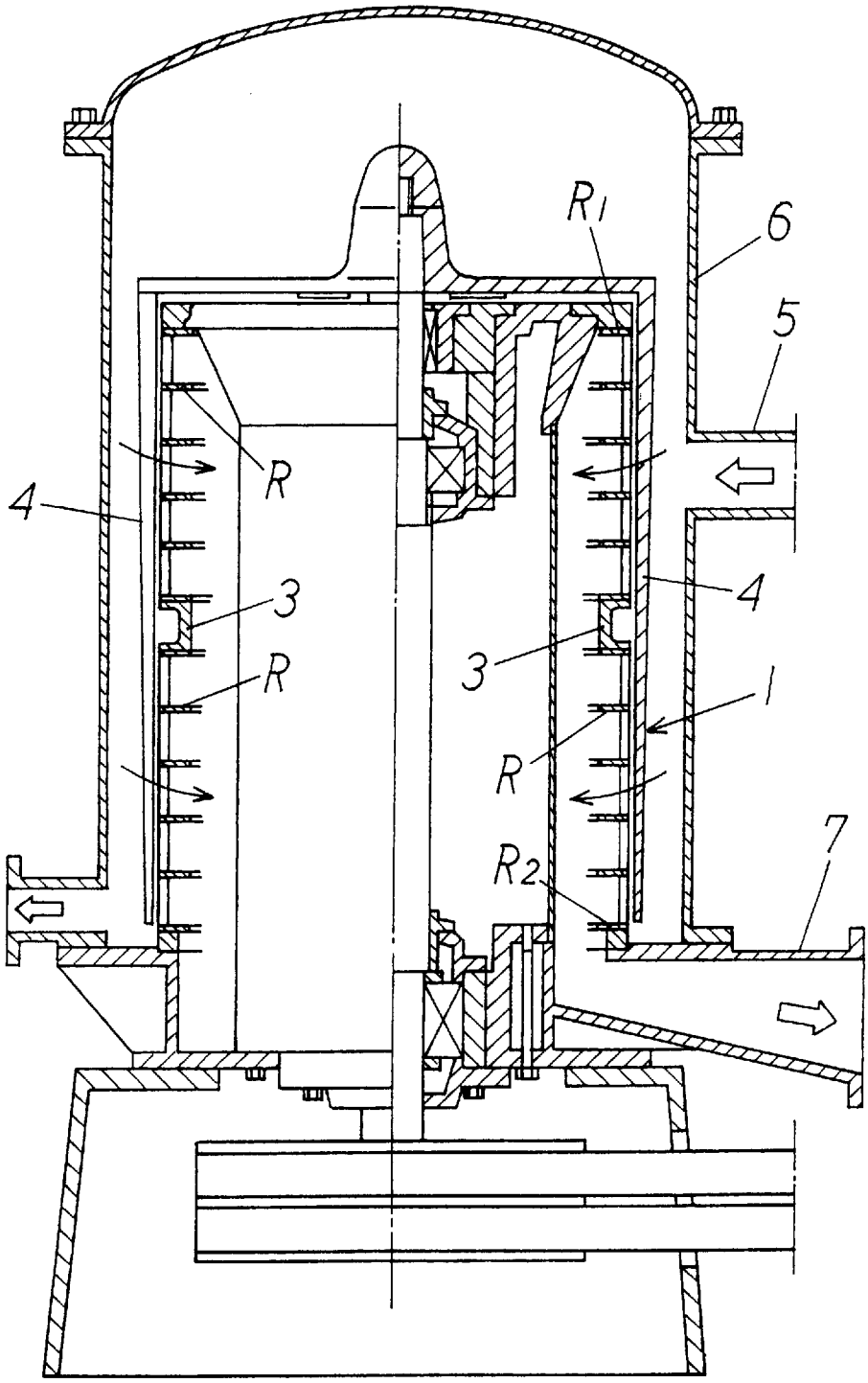
FIG. 1 is a schematic sectional view of a screen apparatus, in which a cylindrical screen according to an embodiment of the invention is installed.
Figure 2:
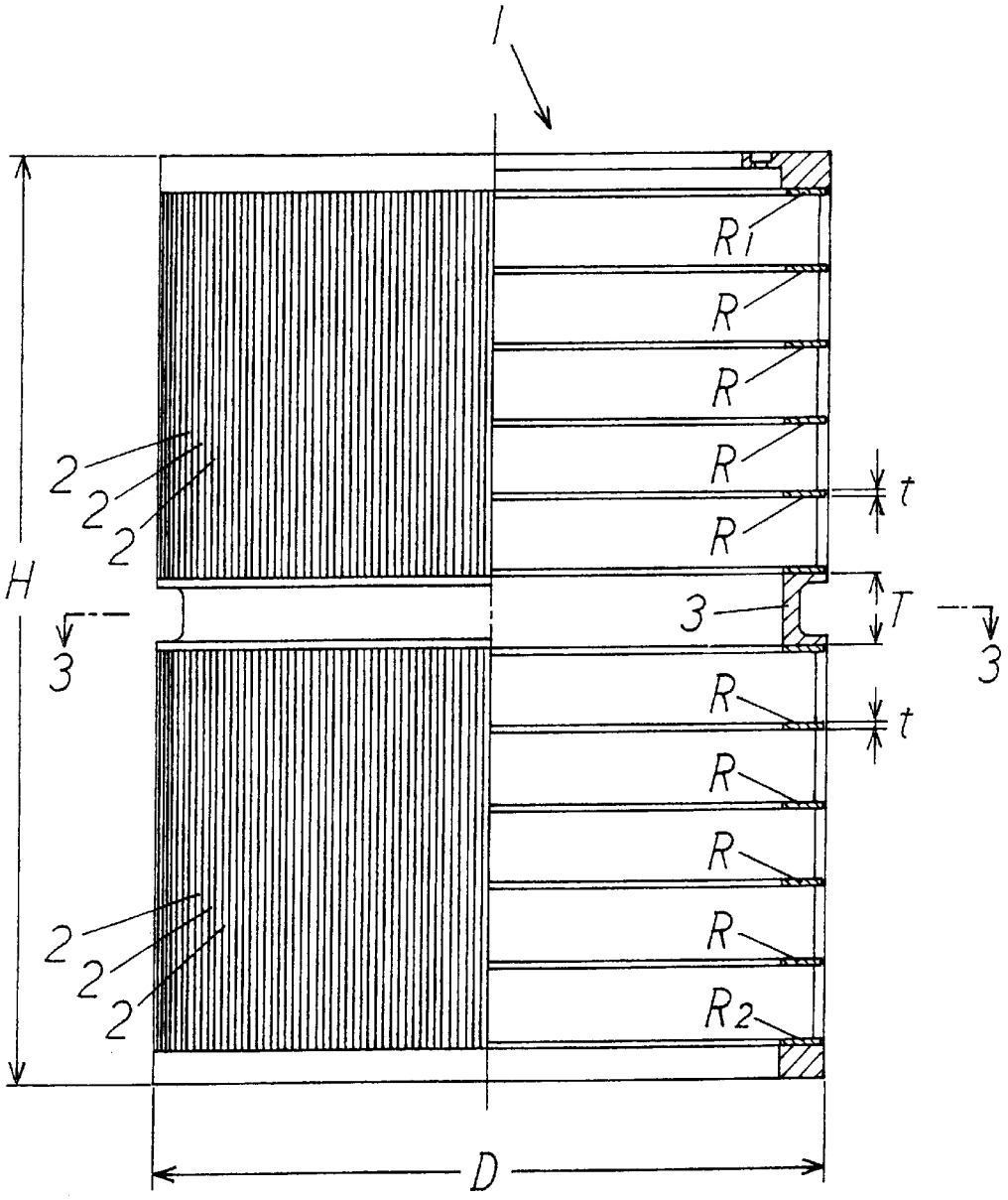
FIG. 2 is a schematic front view of the cylindrical screen of FIG. 1, shown partly in section.
Figure 3:
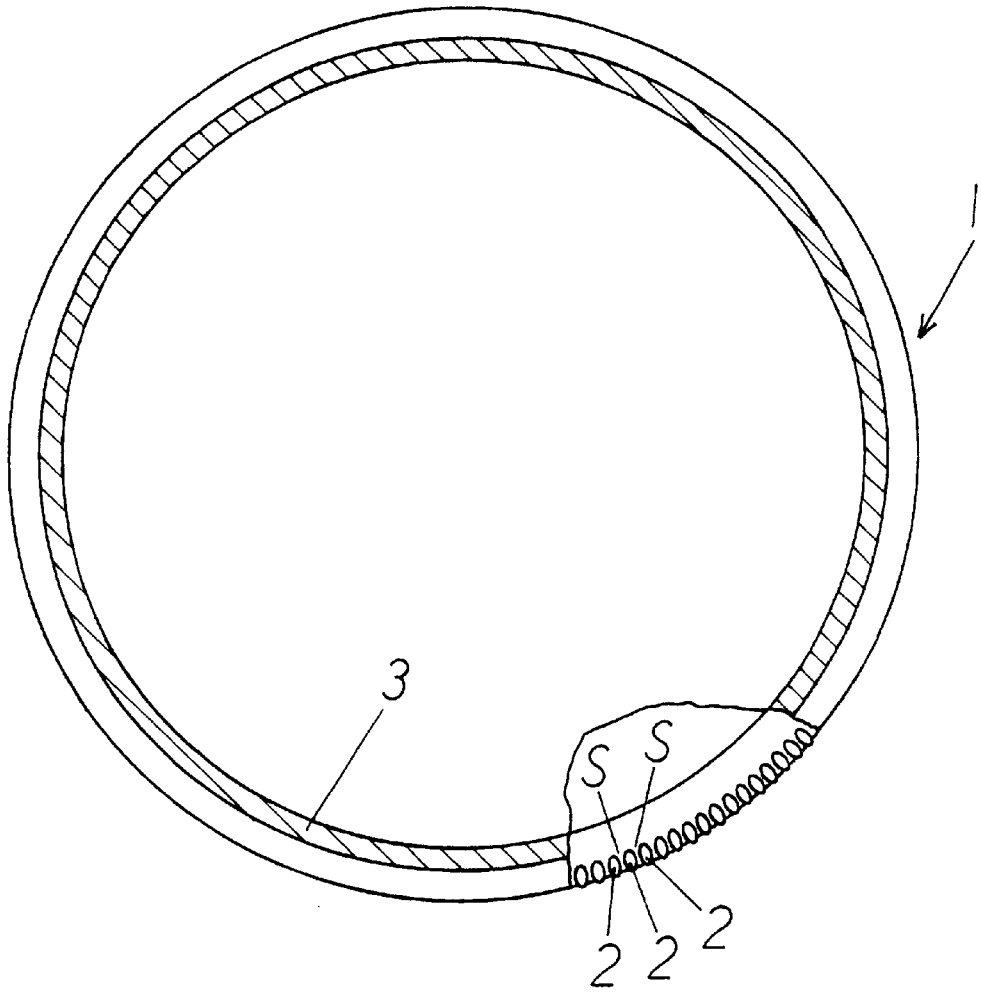
FIG. 3 is a schematic cross sectional view taken along line 3—3 in FIG. 2.

In FIG. 1 through FIG. 3, reference numeral 1 denotes a screen in a cylindrical form, and more specifically, reference numeral 1 is a papermaking screen in a cylindrical form which separates foreign substances from a papermaking material.

In the cylindrical screen 1, screen bars 2 are disposed in parallel with intervals therebetween, and a height H of the cylindrical screen 1 is larger than a diameter D thereof ($D<H$).

Then, screen bars 2 adjacent to each other form a slit S in a longitudinal form (an elongate space), and the screen bars 2 are engaged with and stopped by stopping portions formed at, for example, outer peripheries (alternatively, inner peripheries inside) of rings R.

Also, in the screen bars 2, the slits S in the longitudinal form are cut in the middle by a member 3 having a width T larger than a thickness t of the ring R ($T>t$) and disposed in a direction transversely crossing the longitudinal direction of the screen bar 2. The member 3 is formed into a concave portion which is concaved inwardly, and an opening portion of the concave portion of the member 3 faces an outside. At the same time, the member 3 is formed throughout an entire outer periphery of the cylindrical screen 1.

Incidentally, in the cylindrical screen 1, one end of each screen bar 2 at an upper side portion of the screen 1 is supported by a first end plate $R_1$ in a ring form, and the other end of each screen bar 2 at the upper side portion of the screen 1 is supported by the member 3 formed in the ring form. Also, in each of the screen bars 2 at a lower side portion of the screen, one end thereof is supported by the member 3 formed in the ring form, and the other end thereof is supported by a second end plate $R_2$.

Reference numeral 4 denotes an agitator formed outside the cylindrical screen 1, and by utilizing a change of pressure caused at front and rear sides of the agitator 4 by the rotation of the agitator 4, the screen cleaning operation for the screen 1 is carried out.

Therefore, according to the embodiment, a papermaking material entered from a material inlet passage 5 is subjected to an agitating operation by the agitator 4 in a tank 6, and good fibers are guided to an outside of the tank 6 through the longitudinal slits S and an outlet passage 7. It is structured that the foreign substances can not pass through the longitudinal slits S, to thereby remove the foreign substances from the papermaking material.

In this case, the fibers are accumulated on the surface of the screen 1 such that a mat is formed on the screen 1. In the screen bars 2, since the longitudinal slits S are divided in the middle by the member 3, which has the width T larger than the thickness t of the ring R in the direction transversely crossing the longitudinal direction of the screen bars 2, the mat formed on the screen 1 is divided, so that the mat can be easily peeled off due to the agitating operation by the agitator 4. Accordingly, the performance of the screen 1 is prevented from being deteriorated.

Figure 4:
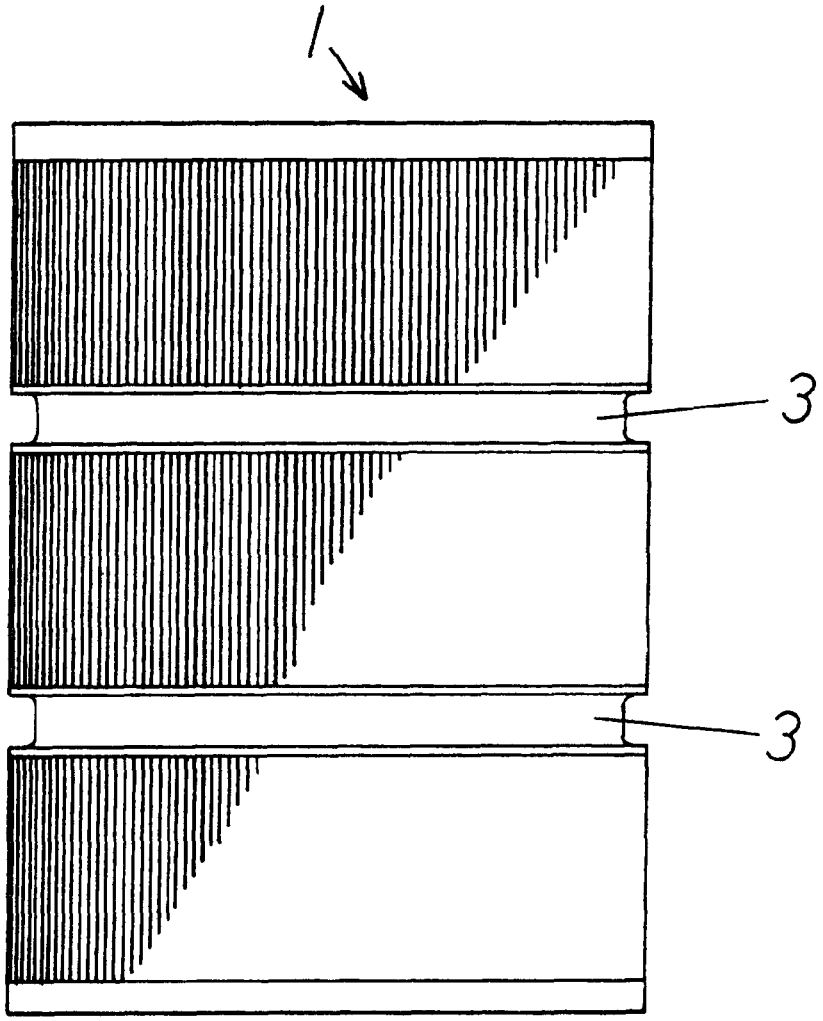
FIG. 4 is a schematic front view of a cylindrical screen according to another embodiment of the invention which differs from the cylindrical screen in FIG. 2.

Incidentally, in the screen bars 2 of the aforementioned embodiment, single member 3 including the width T larger than the thickness t of the ring R is used in the direction transversely crossing the longitudinal direction of the screen bars 2 to thereby divide the longitudinal slits S in the middle. However, in the present invention, the number of the member 3 is not limited to one, and for example, as shown in FIG. 4, a plurality of the members 3 structured as described above can be used.

Also, although the agitator 4 is provided outside of the cylindrical screen 1 in the aforementioned embodiment, the present invention is not limited thereto, and the present invention can be applied to a case in which the agitator 4 is provided inside of the cylindrical screen 1.

Further, as shown in FIG. 1 through FIG. 4, in case the member 3 is formed with the concave portion concaved toward an inner side of the screen 1, foreign substances which can not pass through the screen 1 tend to be accumulated in the concave portion of the member 3, so that the foreign substances in the papermaking material passing through the slits S are reduced by an amount of the foreign substances accumulated in the concave portion. Therefore, a screening effect by the screen 1 can be improved.

Also, although the screen bars 2 are disposed in parallel to each other with intervals therebetween to form the slit S in the cylindrical screen 1 of the aforementioned embodiment, the present invention is not limited to this embodiment. The present invention can be similarly applied to a cylindrical screen in which slits S are formed on an outer peripheral surface of a screen plate as shown in FIG. 5, and also can be applied to a cylindrical screen 1 in which round holes S' are formed on the outer peripheral surface of the screen plate as shown in FIG. 6.

Figure 5:
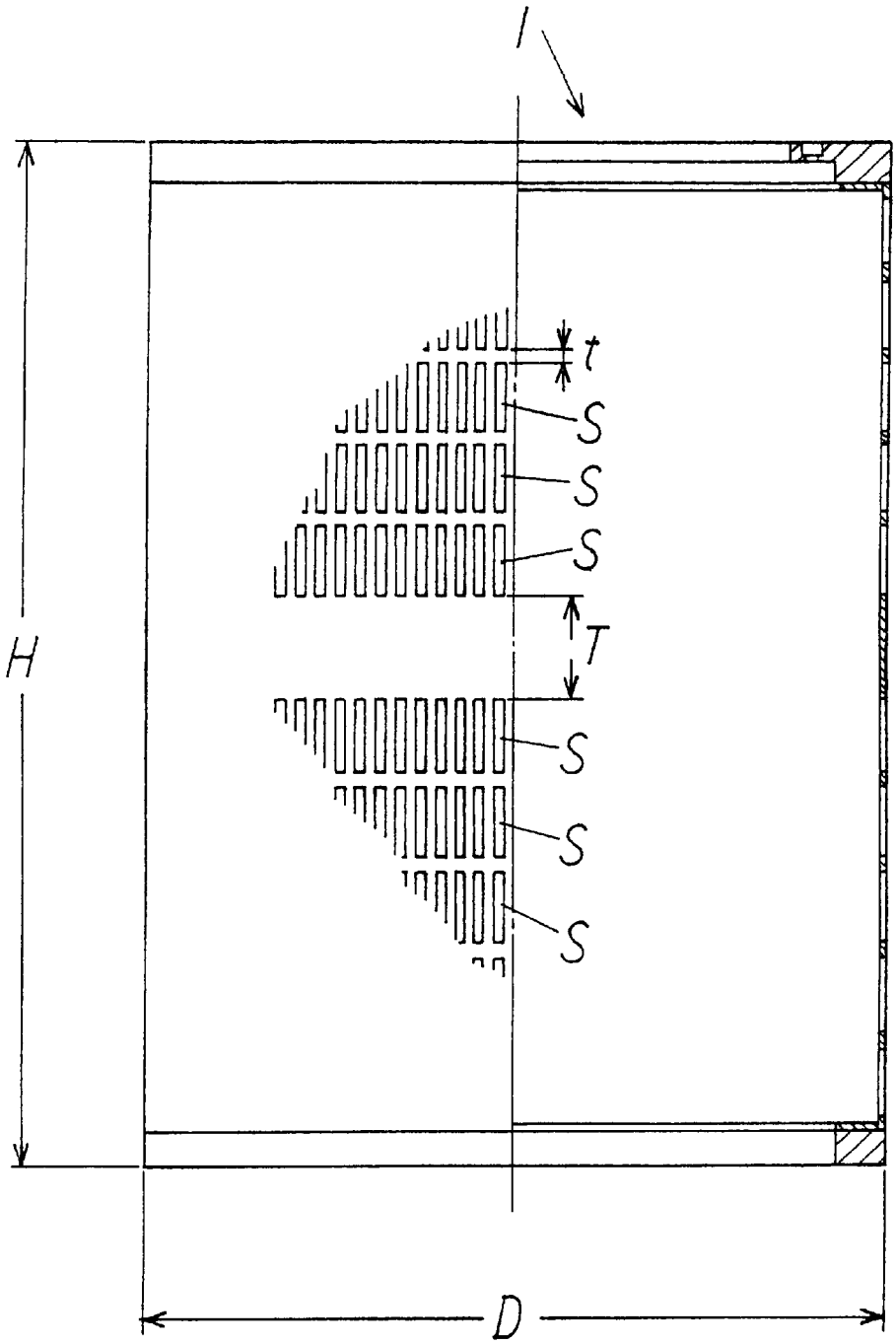
FIG. 5 is a schematic, partly sectional front view of a cylindrical screen according to another embodiment of the invention which differs from the cylindrical screen in FIG. 4.

In case of FIG. 5, a plurality of the slits S is disposed with intervals t therebetween in a vertical direction, and in the middle thereof, an interval T larger than the interval t (T>t) is provided.

Figure 6:
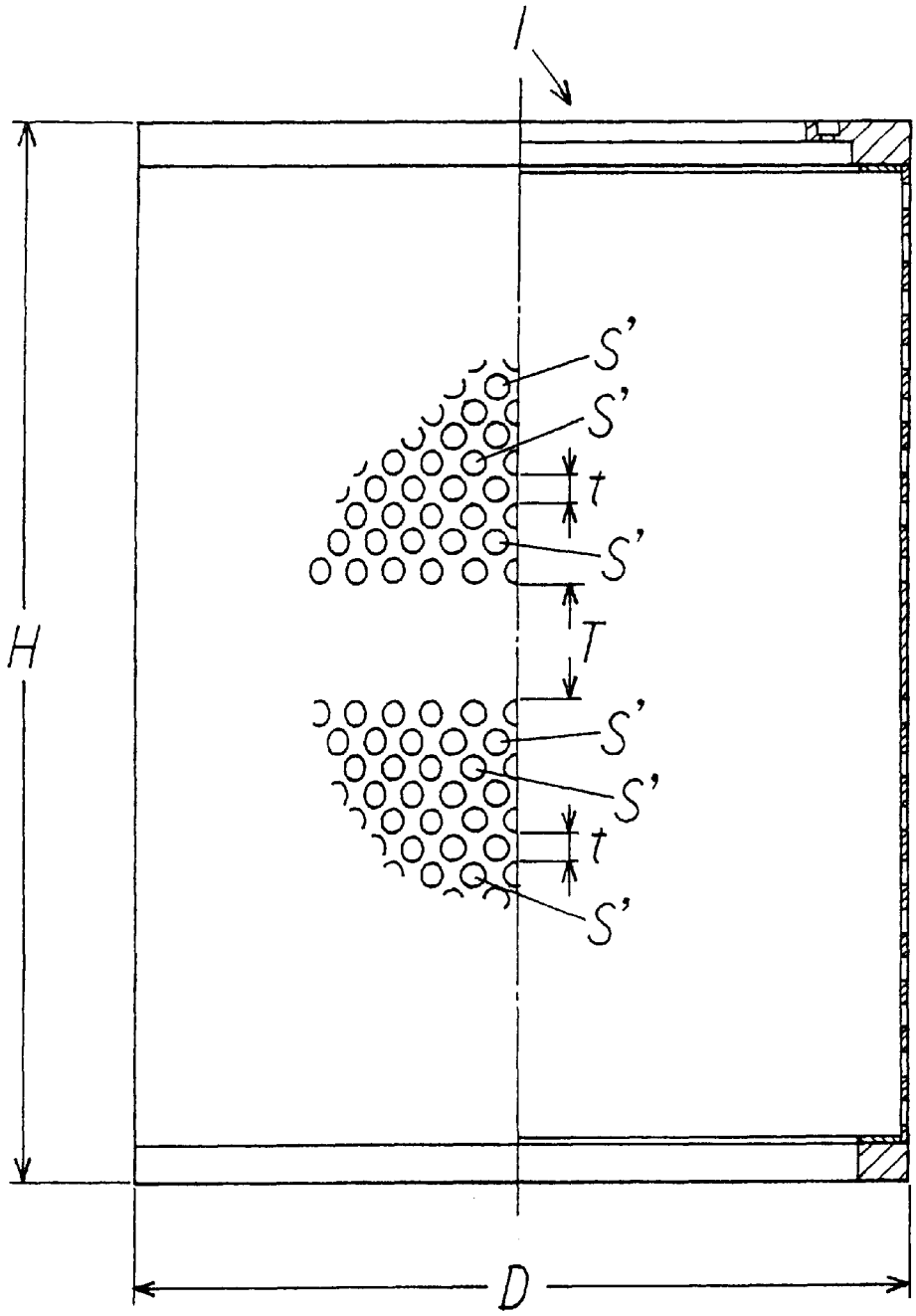
FIG. 6 is a schematic, partly sectional front view of a cylindrical screen according to another embodiment of the invention which differs from the cylindrical screen in FIG. 5.

Incidentally, in case of the round holes S' shown in FIG. 6, a plurality of round holes S' is disposed with intervals t therebetween in a vertical direction, and in the middle thereof, an interval T larger than the interval t (T>t) is provided.

Figure 7:
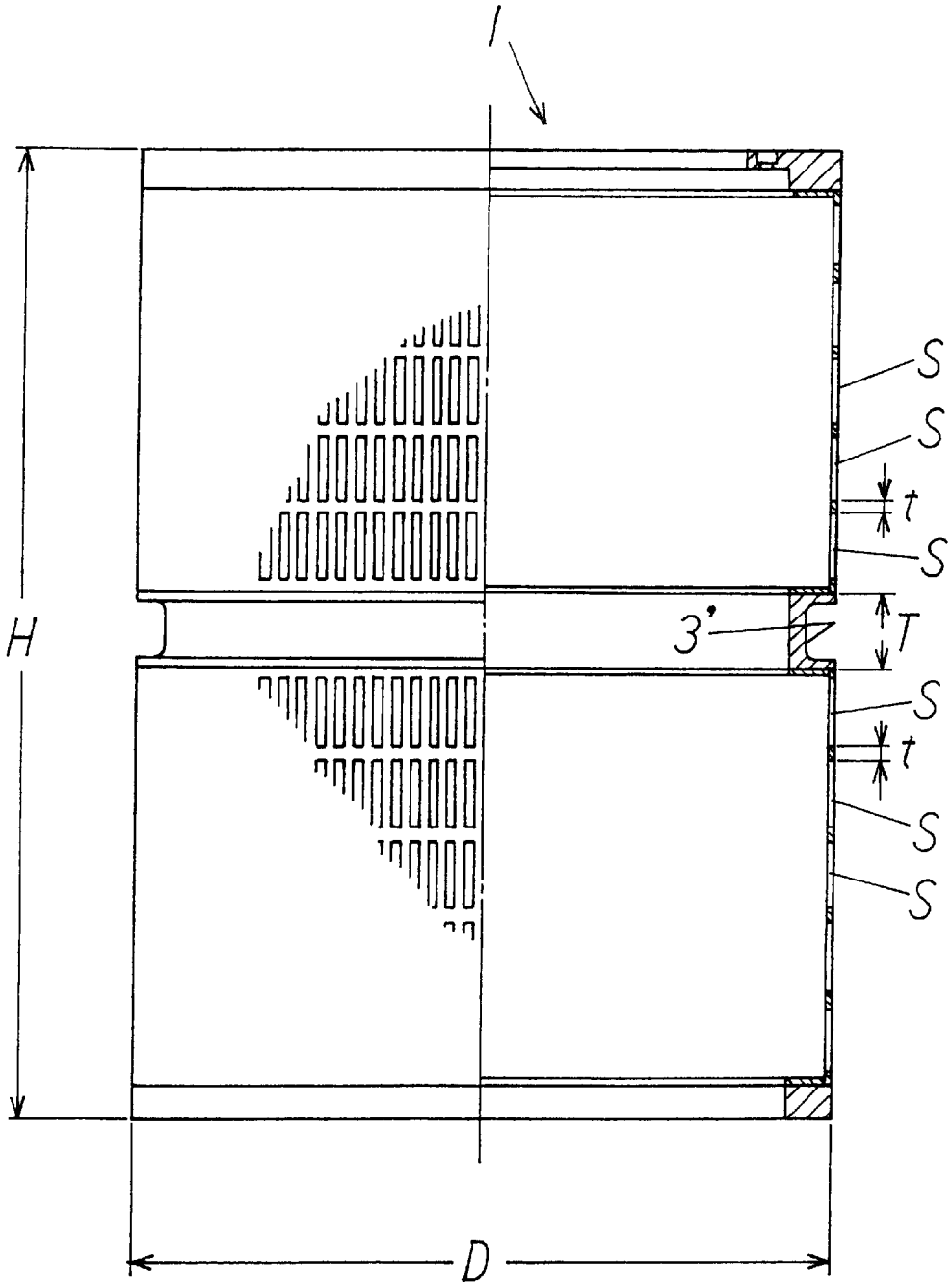
FIG. 7 is a schematic, partly sectional front view of a cylindrical screen according to another embodiment of the invention which differs from the cylindrical screen in FIG. 6.
Figure 8:
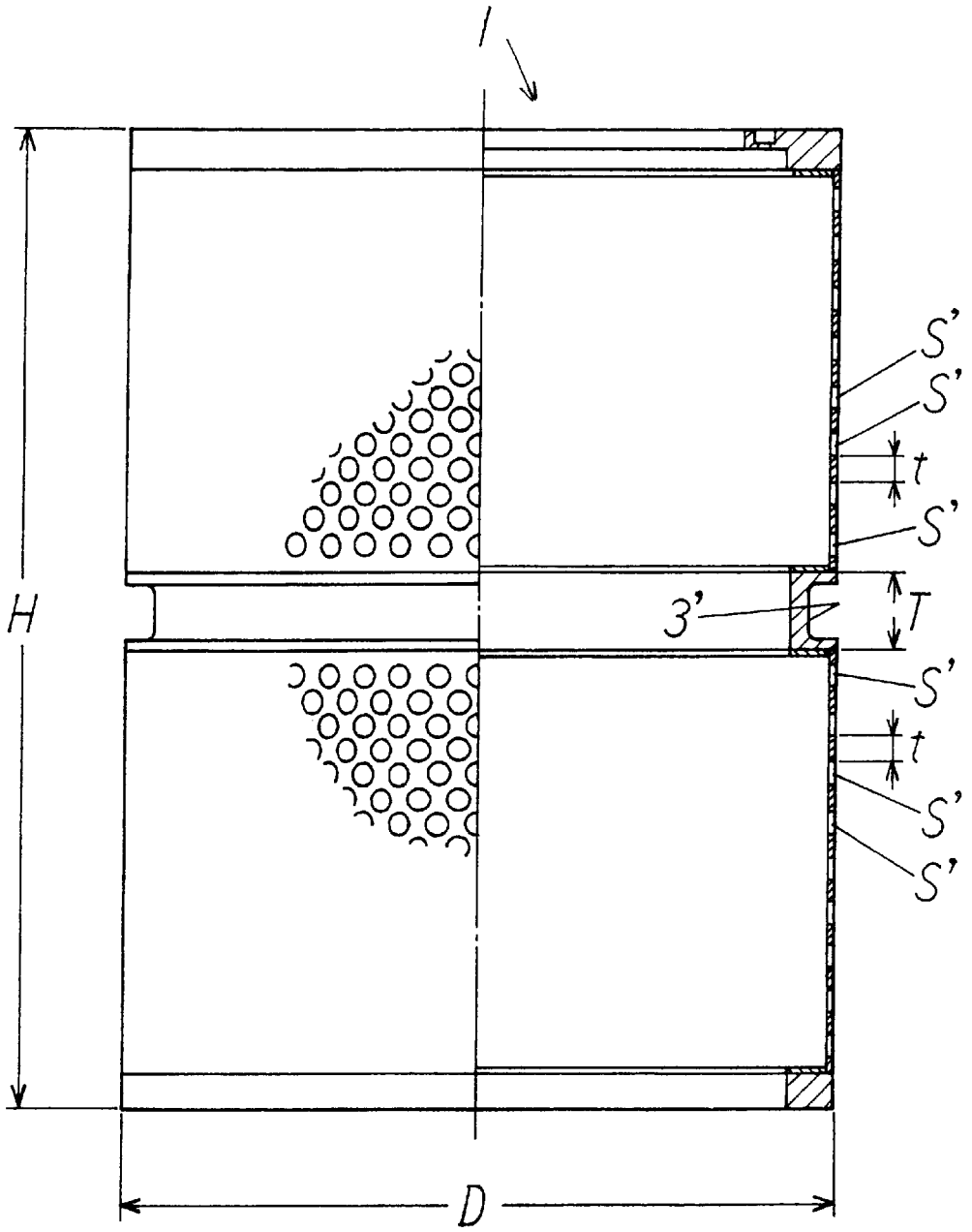
FIG. 8 is a schematic, partly sectional front view of a cylindrical screen according to another embodiment of the invention which differs from the cylindrical screen in FIG. 7.

Further, as same as in the aforementioned embodiment of FIGS. 1 through 4, as shown in FIG. 7 and FIG. 8, a portion of an outer peripheral surface of a screen plate at an interval T is formed into a concave portion 3' concaved inwardly, and an opening portion of the concave portion 3' faces the outside. At the same time, the concave portion 3' is formed throughout an entire outer periphery of the cylindrical screen 1.

Incidentally, as in the embodiment shown in FIGS. 1 through 4, the foreign substances which can not pass through the screen 1 tend to be accumulated also in this concave portion 3', and the foreign substances in the papermaking material passing through the slits S or the round holes S' are reduced by the amount of the foreign substances accumulated in the concave portion 3', so that the screening effect by the screen 1 can be improved.

According to the cylindrical screen of a first aspect of the invention, in the screen bars, the longitudinal slits are divided in the middle by the member having the width larger than the thickness of the ring in the direction transversely crossing the longitudinal direction of the screen bars, the mat adhering to the outer peripheral surface of the screen is easily peeled off, so that the screening effect by the screen can be improved.

Also, according to the cylindrical screen of a second aspect of the invention, in addition to the effect of the first aspect of the invention, the foreign substances which can not pass through the screen tend to be accumulated in the concave portion of the member, so that the foreign substances in the papermaking material passing through the slits are reduced by the amount of the foreign substances accumulated in the concave portion. Accordingly, the screening effect by the screen can be improved.

Further, according to the cylindrical screen of a third aspect of the invention, a plurality of slits is disposed with the intervals t therebetween in the vertical direction, and at the same time, the interval T larger than the interval t (T>t) is provided in the middle. Accordingly, the mat formed on the screen plate is divided, and it becomes easier to peel off the mat due to the division of the mat, so that the screening effect by the screen can be improved.

Also, according to the cylindrical screen of a fourth aspect of the invention, since a plurality of round holes is disposed with intervals t therebetween in a vertical direction and the interval T larger than the interval t (T>t) is provided in the middle, the mat formed on the screen plate is divided, and it becomes easier to peel off the mat due to the division of the mat, so that the screening effect by the screen can be improved.

Furthermore, according to the cylindrical screen of a fifth aspect of the invention, in addition to the effect of the third aspect or the fourth aspect of the invention, the portion of the outer peripheral surface of the screen plate at the interval T is formed into a concave portion S' concaved inwardly, and the foreign substances which can not pass through the screen tend to be accumulated in the concave portion S'. Thus, the foreign substances in the papermaking material passing through the slits or the round holes are reduced by the amount of the foreign substances accumulated in the concave portion S', so that the screening effect by the screen can be improved.

While the invention has been explained with reference to the specific embodiments of the invention, the explanation is illustrative and the invention is limited only by the appended claims.

What is claimed is:

1. A cylindrical screen, comprising:

a plurality of screen bars disposed in spaced, parallel relation in a circular array to define a cylindrical screen body, said screen body having a height greater than its diameter, said screen bars defining a plurality of elongated screen slits between each adjacent pair of the screen bars in the circular array, a ring member engaging and supporting said screen bars, and at least one annular member disposed perpendicular to an axial direction of the screen body and having a width extending along the screen bars, said width being greater than the thickness of said ring member, said annular member extending around said cylindrical screen body to divide said screening slits at a location intermediate between their ends, said at least one annular member being located along an outer surface of the screen body and having an annular concave formed in a middle thereof and extending toward an inner side of the screen body from the outer surface of the screen body.

2. A cylindrical screen, comprising:

a screen body having a height greater than its diameter, and formed of a plurality of portions spaced apart from each other in a direction of the height, each portion having slits laterally and vertically spaced apart from each other, and at least one annular member situated between two of the plurality of the portions of the screen body along an outer surface of the screen body, said at least one annular member having an annular concave formed in a middle thereof and extending toward an inner side of the screen body from the outer surface of the screen body, and a width extending in the direction of the height, said width being greater than a distance of the slits vertically spaced apart from each other.

3. A cylindrical screen according to claim 2, wherein said annular member has a C-shape in section.

4. A cylindrical screen according to claim 2, wherein each of the portions of the screen body includes a plurality of screen bars parallel to each other with a space between two of the screen bars in a circular array to define a plurality of elongated screen slits, and a ring member disposed parallel to the at least one annular member to engage and support the screen bars, said ring member separating the slits vertically.

5. A cylindrical screen according to claim 4, wherein said annular member has upper and lower portions with concaves, said screen bars being located in the concaves and fixed thereto.

6. A cylindrical screen according to claim 2, wherein each of the portions of the screen body is formed of a cylindrical screen plate having a plurality of screening openings formed therein as the slits.

* * * * *